US010464703B2

(12) United States Patent
Malick et al.

(10) Patent No.: US 10,464,703 B2
(45) Date of Patent: Nov. 5, 2019

(54) APPARATUS AND METHOD FOR FILLING CAPSULES

(71) Applicant: Fette Engineering GmbH, Schwarzenbek (DE)

(72) Inventors: Daniel Malick, Ahrensburg (DE); Fabian Scheffler, Hamburg (DE); Jörg Gaedecke, Geesthacht (DE); Werner Seifert, Wentorf (DE); Thomas Heinrich, Stelle (DE); Jan-Eric Kruse, Meerbusch (DE)

(73) Assignee: Fette Engineering GmbH, Schwarzenbek (DE)

( * ) Notice: Subject to any disclaimer, the term of this patent is extended or adjusted under 35 U.S.C. 154(b) by 669 days.

(21) Appl. No.: 14/559,905

(22) Filed: Dec. 3, 2014

(65) Prior Publication Data

US 2015/0158614 A1 Jun. 11, 2015

(30) Foreign Application Priority Data

Dec. 4, 2013 (DE) ..... 10 2013 113 446

(51) Int. Cl.
*B65B 65/02* (2006.01)
*B65B 65/00* (2006.01)
(Continued)

(52) U.S. Cl.
CPC ..... *B65B 65/02* (2013.01); *A61J 3/074* (2013.01); *B65B 1/04* (2013.01); *B65B 7/28* (2013.01);
(Continued)

(58) Field of Classification Search
CPC .. B65B 65/02; B65B 1/04; B65B 7/28; B65B 43/40; B65B 61/28; B65B 65/003; A61J 3/074
(Continued)

(56) References Cited

U.S. PATENT DOCUMENTS 7,379,783 B2 5/2008 Popp
7,379,784 B2 5/2008 Popp
(Continued)

FOREIGN PATENT DOCUMENTS

DE 197 35 942 A1 3/1999
DE 10 2006 035 280 A1 2/2008
(Continued)

*Primary Examiner* — Robert F Long
*Assistant Examiner* — Xavier A Madison
(74) *Attorney, Agent, or Firm* — Young Basile Hanlon & MacFarlane, P.C.

(57) ABSTRACT

An apparatus for filling capsules comprises a conveyor wheel, on the circumference of which a plurality of capsule holders is provided a conveyor wheel drive that alternately passes through stopping times and movement times, so that the capsule holders move along the conveying path in cycles, and a plurality of process stations disposed along the conveying path. The process stations comprise at least one supply station for supplying capsules to be filled to the conveyor wheel, at least one opening station for opening the capsules by separating the upper and lower capsule parts, at least one filling station for filling the lower capsule parts, at least one closing station for closing the filled capsules by connecting the upper and lower capsule parts, and at least one discharge station for discharging the filled capsules. A method for filling capsules is also described.

21 Claims, 2 Drawing Sheets

(51) Int. Cl.

| | |
|---|---|
| ***B65B 43/40*** | (2006.01) |
| ***B65B 61/28*** | (2006.01) |
| ***B65B 1/04*** | (2006.01) |
| ***B65B 7/28*** | (2006.01) |
| ***A61J 3/07*** | (2006.01) |

(52) U.S. Cl.
CPC ..... *B65B 43/40* (2013.01); *B65B 61/28* (2013.01); *B65B 65/003* (2013.01)

(58) Field of Classification Search
USPC ..... 53/468, 267
See application file for complete search history.

(56) References Cited

U.S. PATENT DOCUMENTS

| | | | | |
|---|---|---|---|---|
| 7,392,107 | B2 | 6/2008 | Popp | |
| 7,799,273 | B2 | 9/2010 | Popp | |
| 8,660,680 | B2 | 2/2014 | Poop | |
| 2001/0047837 | A1 | 12/2001 | Parks et al. | |
| 2005/0217207 | A1* | 10/2005 | Konishi | A61J 3/072 53/53 |
| 2005/0217752 | A1* | 10/2005 | Facchini | A61J 3/074 141/146 |
| 2010/0164144 | A1* | 7/2010 | Kuhnle | A61J 3/074 264/334 |
| 2014/0094949 | A1 | 4/2014 | Popp | |

FOREIGN PATENT DOCUMENTS

| | | | |
|---|---|---|---|
| DE | 10 2010 040 505 | A1 | 4/2011 |
| EP | 1 512 632 | B1 | 3/2007 |
| EP | 2 135 595 | A1 | 12/2009 |
| JP | S62-64702 | A | 3/1987 |
| JP | 2010-094391 | A | 4/2010 |

* cited by examiner

APPARATUS AND METHOD FOR FILLING CAPSULES

TECHNICAL FIELD

The invention relates to an apparatus and a method for filling capsules composed of an upper capsule part and a lower capsule part.

BACKGROUND

Cycled capsule filling machines have a conveyor wheel, configured as a turntable, for example, on the circumference of which a plurality of capsule holders for accommodating the capsules to be filled is provided. By means of a conveyor wheel drive, the conveyor wheel is moved in cycles along a plurality of process stations disposed along the circumference of the conveyor wheel, the capsule holders passing through the process stations in cycles. Such capsule filling machines form so-called rotary machines. The process stations usually provided include at least one supply station for supplying the capsules to be filled, at least one opening station for opening the capsules to be filled by separating the upper and lower capsule parts, one or more filling stations for filling the lower capsule parts with the respective material, at least one capsule closing station, and at least one capsule discharge station. Furthermore, one or more unused stations can be provided for subsequently adding process stations.

During the cycled conveying of the capsule holders from process station to process station, the conveyor wheel passes through stopping times and movement times. A distinction is made between an indexing time and a holding time. The indexing time defines the time during which the capsule holders are moved from one process station to the next process station. This time is predetermined by the movement time of the conveyor wheel. The holding time defines the time during which the capsule holders are held at the respective process stations to perform the respective process. This time is predetermined by the stopping time of the conveyor wheel.

A machine for filling and closing capsules is known from German Patent Publication No. DE 10 2010 040 505 A1, in which the conveyor wheel is driven by a drive configured as a servomotor. In this manner, the conveying path and the conveying direction are to be variably adjustable during a conveying cycle, for research purposes. The goal there is to reduce the number of drives of the machine to the greatest possible extent. An apparatus for filling capsules is known from European Patent Publication No. EP 1 512 632 B1, in which a filling device is structured as an independent and interchangeable module. The aim is to thus increase the flexibility of the machine. The filling device, configured as a module, possesses its own drive and is mechanically coupled with the machine for operation, and is thereby integrated into the cycled production process.

The cycled movement of the capsule holders is generally implemented by an indexing gear mechanism, which is driven by the conveyor wheel drive. The indexing gear mechanism converts a constant speed of rotation of the conveyor wheel drive into indexing movements, and thus into indexing and holding times. In the indexing gear mechanism, the movement sequence of indexing and holding times is mechanically established by means of suitable cams. A continuously rotating electric motor of the conveyor wheel drive, which drives the indexing gear mechanism, generates a cycle during each of its revolutions via the indexing gear mechanism; in particular, the cycle passes through corresponding indexing angles and holding angles of the cam arrangement. The power take-off of the indexing gear mechanism performs a movement step when the drive passes through the indexing angle, and stands still when the drive passes through the holding angle. The holding and indexing times are therefore established by the holding and indexing angles mechanically implemented in the indexing gear mechanism, and accordingly in principle are in a fixed ratio conforming with the design of the indexing gear mechanism. One mechanical cam disk for controlling the movement sequences in a process station, coupled with the conveyor wheel drive, is generally provided for each process station. Therefore, if the conveyor wheel drive is operated at a different speed of rotation, for example, this accordingly changes the cycle count and the speed of the respective displacement movement of the process stations.

Sometimes it is necessary, for production reasons, to lengthen the holding time of individual process stations. For example, depending on the material to be filled into the capsules, a longer filling time and/or a longer closing time and therefore slower filling or slower closing of the capsules may be necessary. For example, when filling the capsules with a fine-grain powder, attention must be paid during closing to ensure that powder is not undesirably displaced from the capsules by the air displaced during the course of closing. This is less critical, for example, when filling takes place with pellets or tablets that have already been pressed. Also, depending on the respective material and the degree of filling of the capsules, attention must be paid to ensure that the lower capsule parts, which have already been filled, are not moved on too rapidly, in order to prevent the powder from spilling out of the capsules.

Because of the fixed ratio between holding time and indexing time as explained above, the conveyor wheel drive that drives the indexing gear mechanism must be operated more slowly if slower filling is necessary, for example, so that the production by the apparatus is slowed down overall. As a result, the total cycle time composed of holding and indexing times is lengthened. The slowest process station accordingly determines the overall production speed of the machine.

The mechanical coupling between the conveyor wheel drive and the process stations provided for in the state of the art, via the indexing gear mechanism and the mechanical cam disks, also results in disadvantages with regard to installation and setup of the machine. For example, because of the coupling of the drive trains, all the mechanical cam disks must be mechanically coordinated and aligned with one another and with the conveyor wheel in a complicated manner. During the course of setup of the machine, movement of a process station can only take place if the conveyor wheel is also moving. A single process station cannot be moved and adjusted by itself. The mechanical cam disks, once they have been designed, cannot adapt to changing production parameters, for example different speeds of rotation, accelerations or strokes of the individual process stations.

SUMMARY

The invention described herein is based on the object of making available an apparatus and a method, with which it is possible to fill capsules more efficiently and more flexibly in comparison with the state of the art.

According to the teachings herein, an apparatus includes a conveyor wheel, on the circumference of which a plurality of capsule holders is provided which each have a plurality of capsule receptacles for one capsule each, a conveyer wheel drive with which the conveyor wheel can be rotated in cycles, the conveyor wheel alternately passing through stopping times and movement times, so that the capsule holders move along a conveying path in cycles, and a plurality of process stations disposed along the conveying path, the process stations comprising at least one supply station for supplying capsules to be filled to the capsule receptacles, at least one opening station for opening the capsules to be filled by separating upper capsule parts from lower capsule parts, at least one filling station for filling the lower capsule parts with material to be filled in, at least one closing station for closing the filled capsules by connecting the upper capsule parts with the lower capsule parts, and at least one discharge station for discharging the filled capsules. The ratio between stopping times and movement times of the conveyor wheel can be variably adjusted by means of the conveyor wheel drive, at least one of the process stations has at least one drive that can be controlled independently of the conveyor wheel drive for its operation, and a controller device is provided that is configured for controlling the conveyor wheel drive for variable adjustment of the ratio between stopping times and movement times of the conveyor wheel, and/or is configured for controlling at least the drive speed and/or the stroke (for example a closing stroke) of the process station having at least one separate drive, independently of the conveyor wheel drive.

In particular, it can be provided that multiple process stations, preferably each of the process stations, has/have at least one separate drive, the controller device being configured for controlling the conveyor wheel drive for variable adjustment of the ratio between stopping times and movement times of the conveyor wheel, and/or being configured to control at least the drive speed and/or the stroke of the multiple process stations, preferably of each process station, independently of the conveyor wheel drive.

Mechanical cam disks as the interface between the conveyor wheel drive and the process stations are dispensed with, at least with regard to the process station(s) equipped with its/their own drive. Instead, one or more of the process stations is/are equipped with a drive that can be controlled independently of the conveyor wheel drive, so that electronic cam disks are provided in a manner of speaking. In contrast to the previously described art, no attempt is therefore made to reduce the number of drives. On the contrary, the number of drives is intentionally increased in order to increase the productivity of the apparatus during the regular production process. The drives of the process stations can be controlled, at least with regard to their drive speed and/or their stroke, independently of the conveyor wheel drive, particularly the drive speed of the conveyor wheel drive. The change in the stroke can relate to a change in the stroke speed and/or the stroke path. The drives of the process stations are moved synchronously with the conveyor wheel drive in a defined manner, but can be individually adjusted. In this regard, it is not only possible that a drive that can be controlled independently of the conveyor wheel drive controls multiple, in particular even all, process stations, but also that one or more process stations possess an individual drive that can be controlled independently of the conveyor wheel drive.

Furthermore, a conveyor wheel drive is provided with which the stopping times and movement times of the conveyor wheel can be variably adjusted. In this way, the fixed ratio between holding time and indexing time described above is dispensed with. The holding time and the indexing time are uncoupled from one another and can be defined and set in a targeted and flexible manner. As has been explained, the conveyor wheel drive accelerates and brakes the conveyor wheel, configured as a turntable for example, during the indexing time so that the capsule holders are moved from one process station to the next process station during the indexing time. Therefore, as has already been explained, the indexing time is predetermined by the movement time of the conveyor wheel. In contrast, during the holding time the conveyor wheel drive holds the conveyor wheel in position. The holding time is therefore predetermined by the stopping time of the conveyor wheel, as has also already been explained. The conveyor wheel drive or an electric motor of the conveyor wheel drive therefore does not rotate continuously in order to implement the cycled movement. The conveyor wheel drive can be structured in such a manner that it rotates the conveyor wheel in only one direction of rotation. The conveyor wheel drive can furthermore be structured in such a manner that it rotates the conveyor wheel for approaching every process station.

The ratio of stopping times and movement times of the conveyor wheel can therefore be changed according to the invention. Alternatively or additionally, the one or more process stations equipped with at least one separate drive can be driven independently of the conveyor wheel drive during the holding time. In particular, the drives can be operated at different speeds. Applied to the mechanical concepts of indexing angle and holding angle, therefore not only the indexing angle but also the holding angle can be traversed at different speeds according to the invention. In this connection, it is still possible that the displacement path of the process station(s) having at least one separate drive can be controlled independently of the conveyor wheel drive by means of the controller device. In particular, the displacement path can be controlled independently of the displacement path of the conveyor wheel drive. This relates, for example, to the respective strokes of the process stations, which can be flexibly adjusted in a targeted manner, independently of the conveyor wheel drive, for the respective application.

In accordance with a method described herein, in the event of a change in the production parameters that relate to filling the capsules, the ratio between stopping times and movement times of the conveyor wheel is changed, and/or at least the drive speed and/or the stroke of at least one process station is/are changed. In this connection, in the event of a change in production parameters that relate to filling the capsules, the ratio between stopping times and movement times of the conveyor wheel may be changed, and/or at least the drive speed and/or the stroke of multiple process stations may be changed.

According to a corresponding further embodiment of the apparatus according to the invention, in the event of a change in production parameters that relate to filling the capsules, the controller device can be configured for changing the ratio between stopping times and movement times of the conveyor wheel, and/or at least for changing the drive speed and/or the stroke of at least one process station.

The production parameters that relate to filling the capsules can in particular comprise the product to be filled into the capsules. The invention allows flexible adaptation to the respective production parameters, for example the respective product to be filled in, the respective product amount to be filled in and/or the respective filled capsules. Product loss can be minimized and the filling quality can be improved by suitable setting of the indexing and holding times. By means of flexible adaptation of the indexing and holding times and thus individual optimization of the cycle times, more efficient operation and thereby an increase in performance is achieved with simplified service. Drives of the process stations that can be controlled independently of the conveyor wheel drive allow variability of the movement sequences and movement curves, so that the respective process stations can be optimally adjusted, and productivity is increased. This also holds true for process reliability. For example, capsules that have not been separated are always discharged at the optimal speed. The mechanical stress on the capsules, for example when closing the capsules, can be reduced. Mechanical adjustment of the process stations is no longer necessary, because the process stations can be individually adjusted via their respective setting drives.

Multiple sets of production parameters relating to filling the capsules can be stored in the controller device, the controller device, after manual or automatic selection of a set of production parameters, changing the ratio between stopping times and movement times of the conveyor wheel and/or at least changing the drive speed and/or the stroke of at least one process station. For this purpose, the controller device can comprise a memory device in which different sets of production parameters are stored, for example for different capsules to be filled and/or different material to be filled in and/or different product amounts to be filled in. The sets of production parameters can each contain control defaults for the conveyor wheel drive and the drives of the process stations, particularly with regard to their respective cycling, drive speed, their stroke and/or their displacement path. As a function of input by a user, for example, the controller device can then in each instance select the suitable production parameter set. Largely automatic setting of the suitable production parameters then takes place.

Setup of an apparatus according to the invention is also simplified. Due to the uncoupling of one or more drives of the process stations from the conveyor wheel drive and also from one another, the process stations in question can be moved independently of the conveyor wheel or the other process stations during setup operation. As a result, settings can be made and checked in a simple, targeted manner, such as removal by suction of capsules not separated in the opening station. Also, slow startup can take place during setup operation, in that the process stations are connected in succession to the overall process. The individual controllability of the process stations also offers simplification of service and maintenance, because any desired positions of individual process stations can be approached for service or maintenance purposes, for example.

In an apparatus according to the invention, in principle one or more unused stations can be provided for subsequent addition of process stations. Also, multiple filling stations for filling capsules with different material, if applicable, can be provided. Furthermore, it is of course possible to combine process stations of the apparatus with one another. For example, a combined supply and opening station could be provided, in which the capsules to be filled are passed to the capsule receptacles and opened by separating the upper capsule parts from the lower capsule parts.

One or more of the process stations can also have multiple drives, all of which can be controlled independently of the conveyor wheel drive. The capsule holders can each have a first and a second row of capsule receptacles. It is then possible to provide only one supply station that is configured for supplying capsules to both rows of capsule receptacles of a capsule holder. However, two supply stations can also be provided, of which one supplies capsules to the first row and one supplies capsules to the second row. Furthermore, at least one collection device may be disposed in such a manner that the capsules discharged in at least one discharge station are passed to it. Furthermore, at least one testing device can be provided for testing the capsules filled in the process stations.

Also, at least two path sections, disposed one behind the other, may be formed along the conveying path, with a first station group of process stations disposed one behind the other being provided along a first path section, and with at least one further station group of process stations disposed one behind the other being disposed along at least one further path section. Each of the station groups can then comprise at least one supply station for supplying capsules to be filled to the capsule receptacles, at least one opening station for opening the capsules to be filled by separating the upper capsule parts from the lower capsule parts, at least one filling station for filling the lower capsule parts with material, at least one closing station for closing the filled capsules by connecting the upper capsule parts with the lower capsule parts, and at least one discharge station for discharging the filled capsules. This can therefore be a so-called multiple rotary unit, particularly a double rotary unit.

The conveyor wheel drive can be a servo drive, comprising a servomotor that drives the conveyor wheel in rotation via a gear mechanism. It is also possible that the conveyor wheel drive is a direct drive, particularly a torque drive. In this case, the conveyor wheel drive therefore acts on the conveyor wheel without a gear mechanism. Both types of drives are particularly suitable for a discontinuous drive of the conveyor wheel, in other words, displacement during the indexing times and stopping during the holding times, and offer variable adjustability of the movement times and stopping times of the conveyor wheel. The drives of the process stations can in principle be selected from the group of servo drives, direct drives, linear drives, etc. With these variants, essentially any desired constellation of indexing and holding times can be implemented.

In the sense of the most compact configuration possible, at least one discharge station can comprise a device for separating good capsules from bad capsules.

A method according to the invention can be carried out with an apparatus according to the invention. Analogously, an apparatus according to the invention can be suitable for carrying out a method according to the invention.

BRIEF DESCRIPTION OF THE DRAWINGS

One exemplary embodiment of the invention will be explained in greater detail below with reference to figures wherein.

Unless otherwise indicated, the same reference symbols in the figures refer to the same object.

DETAILED DESCRIPTION

Figure 1:
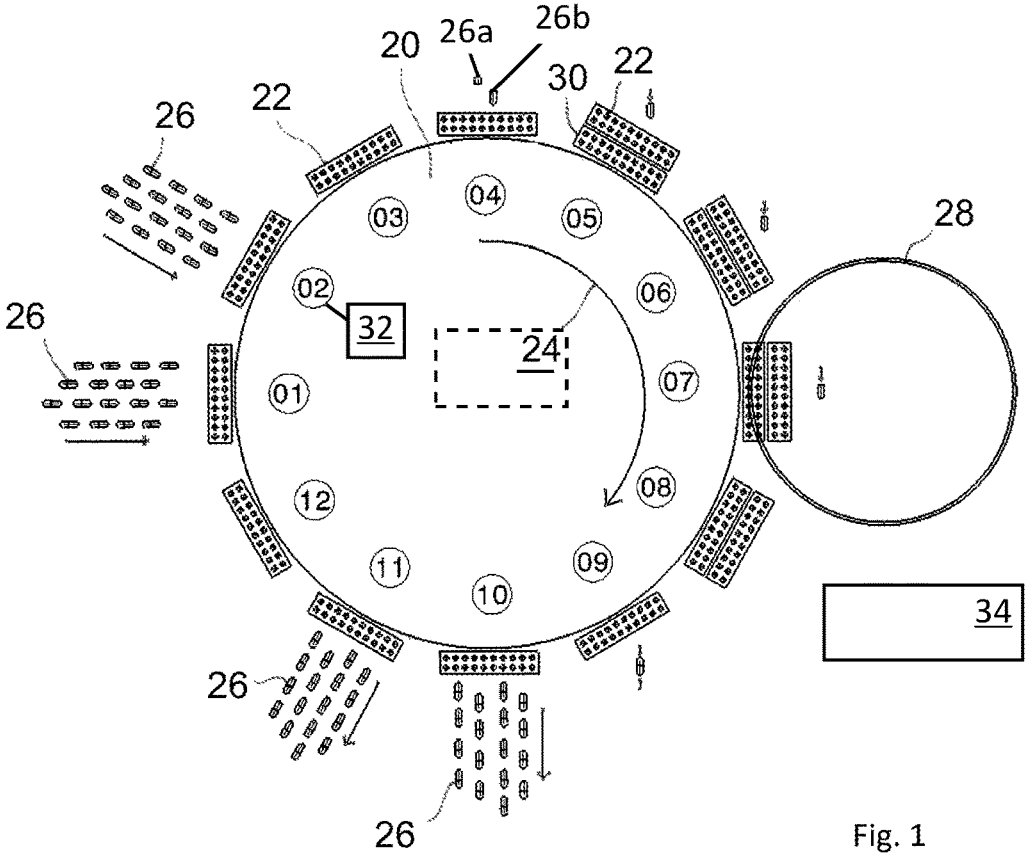
FIG. 1 is a schematic top view of an apparatus for filling capsules composed of an upper capsule part and a lower capsule part.

The apparatus according to an embodiment of the invention shown in FIG. 1 comprises a conveyor wheel 20, structured as a circular turntable in the example shown. A plurality of capsule holders 22 is disposed along the circumference of the conveyor wheel 20 and held by the conveyor wheel 20. The capsule holders 22 each possess two rows of capsule receptacles for one capsule each. By means of a conveyor wheel drive 24, not shown in greater detail, the conveyor wheel 20 is rotated in cycles. For example, a torque drive may rotate the conveyor wheel 20 clockwise as illustrated in FIG. 1 by the arrow. In this connection, the capsule holders 22 are moved in cycles along a conveying path through different process stations, as is basically known.

The process stations are numbered with the numbers 01 to 12 in FIG. 1, and are shown only in part. The stations 01 and 02 are supply stations, in which pre-closed capsules 26 to be filled are passed to the first or second row of the capsule receptacles. The station 03 is an opening station, in which the capsules to be filled are opened by separating the upper capsule parts 26*a* from the lower capsule parts 26*b*. In this case, the station 04 is an unused station. However, it is also possible that the opening station is formed by the process station 04, and the process station 03 is an unused station. The process stations 05, 06 and 07 can be filling stations, in which the lower capsule parts 26*b* are filled with the material to be filled in. This is shown as an example by the filling wheel 28 in FIG. 1. It is also possible that one or two of the process stations 05, 06 and 07 is/are unused stations. The process station 08 can be an unused station, or capsules not opened in the opening station can be discharged in the process station 08. In the process stations 05, 06, 07 and 08, along with the capsule holders 22 that carry the lower capsule parts 26*b* in the open state of the capsules 26, capsule holders 30 for holding the upper capsule parts 26*a* are shown. Capsule holders 30 are disposed further radially inwardly than capsule holders 22. The process station 09 is a closing station, in which the filled capsules are closed by connecting the upper capsule parts 26*a* with the lower capsule parts 26*b*. The process stations 10 and 11 are each discharge stations. For example, bad capsules can be discharged in the process station 10, and good capsules can be discharged in the process station 11. The distinction is made using one or more testing devices. The process station 12 can be an unused station or, for example, a cleaning station in which the capsule holders 22 are cleaned to remove any product residues that might be present.

According to embodiments of the invention, each of the process stations has at least one separate drive 32. Furthermore, a controller device 34 is provided, via which at least the drive speed and the displacement path of the drives of the process stations can be controlled independently of the conveyor wheel drive.

Figure 2:
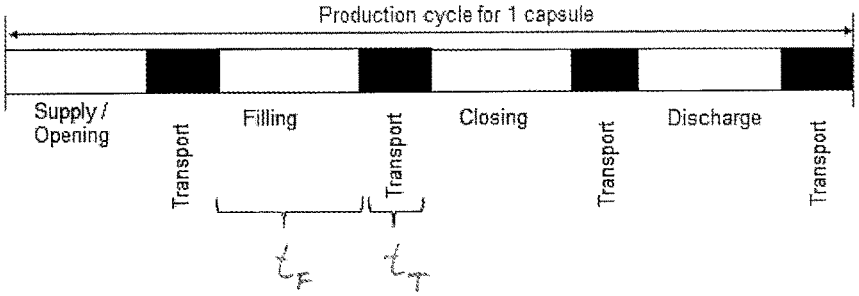
FIG. 2 is an illustration of a production cycle in an apparatus for filling capsules composed of an upper capsule part and a lower capsule part.

Variants of the controller according to the invention will be explained with reference to FIGS. 2 to 4. A production cycle over time for a capsule to be filled is shown in FIG. 2. The white fields each show holding times, during which the conveyor wheel 20 stands still and the process stations are driven to perform their respective activities. The black fields each show indexing times, during which the conveyor wheel 20 is rotated further in order to move the capsule holders 22 from one process station to the next process station. In FIG. 2, the holding times and indexing times are shown as examples for the following process steps: supplying and opening (Supply/Opening), filling the capsules (Filling), closing the capsules (Closing), and discharging the capsules (Discharge). The indexing times are indicated by $t_T$, while the holding time for filling the capsule, for example, is indicated by $t_F$. In conventional apparatuses, the holding and indexing times are set in a fixed manner once for a process, and then are always the same in terms of their ratio.

Figure 3:
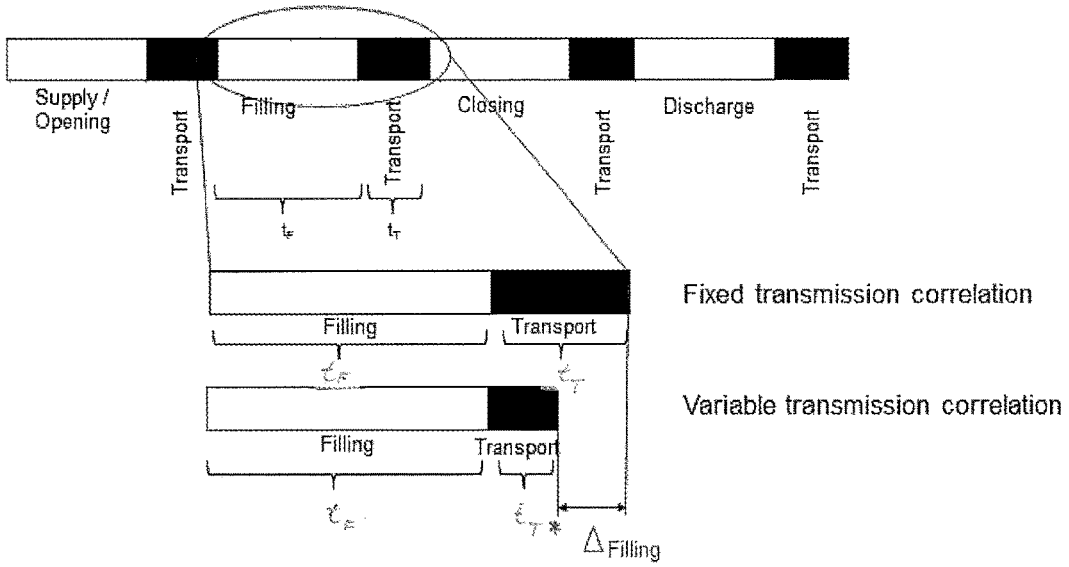
FIG. 3 is an explanation of a method according to the invention, with reference to a further illustration of a production cycle in an apparatus for filling capsules composed of an upper capsule part and a lower capsule part.

With reference to the filling process, it is shown in FIG. 3 how the uncoupling of the holding and indexing times according to the invention can shorten the production time. In the "Fixed transmission correlation" section, the fixed ratio between filling time $t_F$ and indexing time $t_T$ illustrated in FIG. 2 is shown. In the "Variable transmission correlation" area, it is shown how a shortened indexing time $t_T$* for further transport from the filling station to the closing station is set while the filling time $t_F$ remains the same. This can take place, for example, due to a change in the product to be filled in. Using this example, a time savings in filling results, which is indicated by $\Delta_{Filling}$ in FIG. 3. Analogously, of course, it would also be possible to change the filling time $t_F$ as a function of the respective production parameters, for example to even lengthen it independently of the indexing time.

Figure 4:
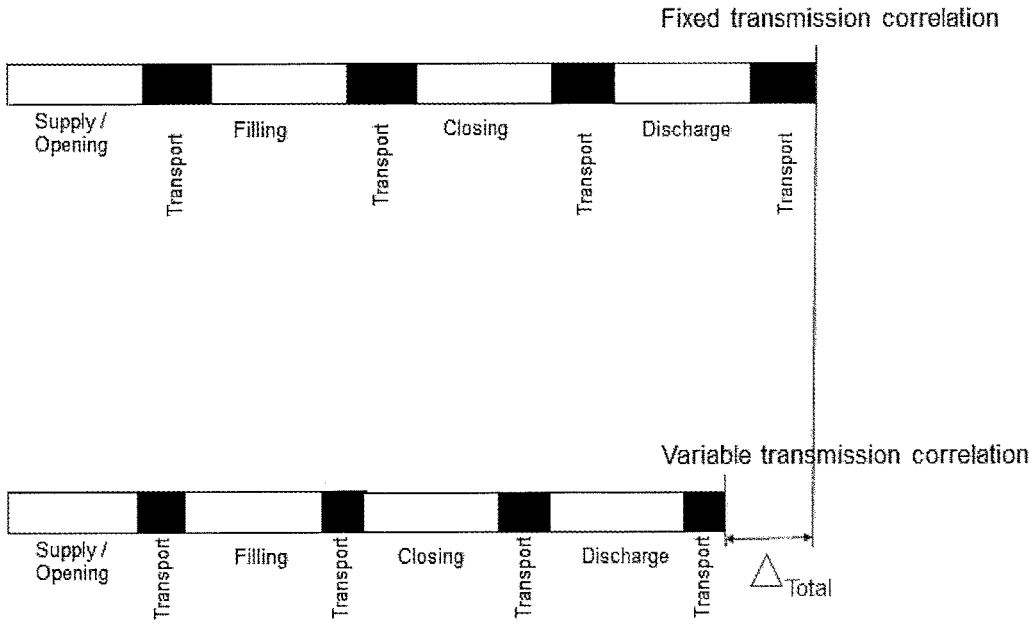
FIG. 4 is a further illustration of a production cycle in an apparatus for filling capsules composed of an upper capsule part and a lower capsule part.

FIG. 4 shows the uncoupling of the indexing and holding times as an example of a further variant of the invention. Once again, the production cycle shown in FIG. 2 is shown in the "Fixed transmission correlation" section. In the "Variable transmission correlation" section, the indexing time between the process stations has been changed in a suitable manner, in particular shortened, with the holding times for the individual process stations remaining the same. As a result, a time savings in the production cycle results, which is shown by $\Delta_{Total}$ in FIG. 4.

The invention claimed is:

1. An apparatus for filling capsules having a respective upper capsule part and a respective lower capsule part, the apparatus comprising:

a conveyor wheel, on a circumference of which a plurality of capsule holders is provided, wherein each capsule holder has a plurality of capsule receptacles for one capsule each; a conveyor wheel drive with which the conveyor wheel is rotatable to alternately pass through stopping times and movement times, so that the plurality of capsule holders move along a conveying path in cycles; and a plurality of process stations disposed along the conveying path, wherein the plurality of process stations comprise at least one supply station for supplying capsules to be filled to the capsule receptacles, at least one opening station for opening the capsules to be filled by separating the upper capsule parts from the lower capsule parts, at least one filling station for filling the lower capsule parts with material, at least one closing station for closing the filled capsules by connecting the upper capsule parts with the lower capsule parts, and at least one discharge station for discharging the filled capsules; wherein:

a process station of the plurality of process stations has a process drive that is controlled independently of the conveyor wheel drive, wherein the process drive and the conveyor wheel drive move during cycled conveying of the plurality of capsule holders; and a controller device is configured for controlling the conveyor wheel drive for variable adjustment of associated conveying cycles by variably adjusting a ratio between the stopping times and the movement times of the conveyor wheel, and for controlling at least one of a drive speed or a stroke path of the process station having the process drive independently of the conveyor wheel drive, such that:

during a first cycle along the conveying path through the plurality of process stations, the controller device controls the conveyor wheel according to a first stopping time and a first movement time and controls the process station according to a first drive speed and a first stroke path; and during a second cycle along the conveying path through the plurality of process stations, the controller device controls the conveyor wheel according to at least one of a second stopping time different from the first stopping time or a second movement time different from the first movement time, and controls the process station according to at least one of a second drive speed different from the first drive speed or a second stroke path different from the first stroke path.

2. The apparatus according to claim 1, wherein each of the plurality of process stations has a respective process drive, and wherein the controller device is configured for controlling the conveyor wheel drive for variable adjustment of the ratio between the stopping times and the movement times of the conveyor wheel, and for controlling at least one of the drive speed or the stroke path of each of the plurality of process stations independently of the conveyor wheel drive.

3. The apparatus according to claim 1, wherein the conveyor wheel drive is a servo drive comprising a servomotor that drives the conveyor wheel in rotation via a gear mechanism.

4. The apparatus according to claim 1, wherein the conveyor wheel drive is a torque drive.

5. The apparatus according to claim 1, wherein the process drive of the process station is a drive from a group of servo drives, direct drives, and linear drives.

6. The apparatus according to claim 1, wherein the at least one discharge station separates good capsules from bad capsules.

7. The apparatus according to claim 1, wherein the controller device is configured for, responsive to a change in production parameters relating to filling the capsules, at least one of changing the ratio between the stopping times and the movement times of the conveyor wheel and changing at least one of the drive speed or the stroke path of the process station having the process drive.

8. The apparatus according to claim 1, further comprising:

multiple sets of production parameters relating to filling the capsules stored in the controller device, and wherein the controller device, after selection of a set of production parameters, at least one of sets the ratio between the stopping times and the movement times of the conveyor wheel and sets at least one of the drive speed or the stroke path of the process station having the process drive.

9. The apparatus according to claim 8, wherein the set of production parameters includes the material to be filled into the capsules.

10. A method for filling capsules including a respective upper capsule part and a respective lower capsule part, in which a conveyor wheel, on a circumference of which a plurality of capsule holders is provided, wherein each capsule holder has a plurality of capsule receptacles for one capsule each, is rotated in cycles, wherein the conveyor wheel alternately passes through stopping times and movement times, so that the plurality of capsule holders move in cycles along a plurality of process stations disposed along a conveying path, wherein the plurality of process stations comprise at least one supply station for supplying capsules to be filled to the capsule receptacles, at least one opening station for opening the capsules to be filled by separating the upper capsule parts from the lower capsule parts, at least one filling station for filling the lower capsule parts with material, at least one closing station for closing the filled capsules by connecting the upper capsule parts with the lower capsule parts, and at least one discharge station for discharging the filled capsules, the method comprising:

responsive to a change in production parameters relating to filling the capsules, variably adjusting associated conveying cycles by changing a ratio between the stopping times and the movement times of the conveyor wheel using a conveyor wheel drive such that:

during a first cycle along the conveying path through the plurality of process stations, the conveyor wheel moves according to a first stopping time and a first movement time, and during a second cycle along the conveying path through the plurality of process stations, the conveyor wheel moves according to at least one of a second stopping time different from the first stopping time or a second movement time different from the first movement time; and changing at least one of a drive speed or a stroke path of a process station of the plurality of process stations having a process drive independent of the conveyor wheel drive, such that:

during the first cycle, the process station moves according to a first drive speed and a first stroke path; and during the second cycle, the process station moves according to at least one of a second drive speed different from the first drive speed or a second stroke path different from the first stroke path, wherein the process drive and the conveyor wheel drive move during cycled conveying of the plurality of capsule holders.

11. The method according to claim 10, wherein the change in production parameters comprises a change in the material to be filled into the capsules.

12. The method according to claim 10, wherein multiple sets of production parameters relating to filling the capsules are stored in a controller device, the method further comprising:

after selection of a set of production parameters from the multiple sets of production parameters, using the controller device to at least one of set the ratio between the stopping times and the movement times of the conveyor wheel and set at least one of the drive speed or the stroke path of the process station of the plurality of process stations having the process drive according to the set of production parameters.

13. The method according to claim 10, further comprising:

controlling the drive speed of the process station independent of the conveyor wheel drive.

14. The apparatus according to claim 1, wherein the controller device is configured for controlling the drive speed of the process station having the process drive independently of the conveyor wheel drive.

15. An apparatus for filling capsules having a respective upper capsule part and a respective lower capsule part, the apparatus comprising:

a conveyor wheel, on a circumference of which a plurality of capsule holders is provided, wherein each capsule holder has a plurality of capsule receptacles for one capsule each and the conveyor wheel is rotatable to alternately pass through stopping times and movement times, so that the plurality of capsule holders move along a conveying path in cycles; and a plurality of process stations disposed along the conveying path, wherein the plurality of process stations comprise at least one supply station for supplying capsules to be filled to the capsule receptacles, at least one opening station for opening the capsules to be filled by separating the upper capsule parts from the lower capsule parts, at least one filling station for filling the lower capsule parts with material, at least one closing station for closing the filled capsules by connecting the upper capsule parts with the lower capsule parts, and at least one discharge station for discharging the filled capsules; wherein:

a process station of the plurality of process stations is controlled independently of the conveyor wheel;

the process station and the conveyor wheel are independently controlled during cycled conveying of the plurality of capsule holders;

the conveyor wheel is controlled for variable adjustment of associated conveying cycles by variably adjusting a ratio between the stopping times and the movement times such that:

during a first cycle along the conveying path through the plurality of process stations, the conveyor wheel moves according to a first stopping time and a first movement time; and during a second cycle along the conveying path through the plurality of process stations, the conveyor wheel moves according to at least one of a second stopping time different from the first stopping time or a second movement time different from the first movement time; and at least one of a drive speed and or a stroke path of a process station of the plurality of process stations is controlled independently of controlling the conveyor wheel, such that:

during the first cycle, the process station moves according to a first drive speed and a first stroke path; and during the second cycle, the process station moves according to at least one of a second drive speed different from the first drive speed or a second stroke path different from the first stroke path.

16. The apparatus according to claim 15, wherein the stroke path of each of the plurality of process stations is controlled.

17. The apparatus according to claim 15, wherein the at least one discharge station separates good capsules from bad capsules.

18. The apparatus according to claim 15, further comprising:

production parameters related to filling the capsules, wherein the at least one of the conveyor wheel is controlled for variable adjustment of the ratio between the stopping times and the movement times, and the drive speed and the stroke path of the process station of the plurality of process stations is controlled independently of controlling the conveyor wheel, responsive to a change in the production parameters.

19. The apparatus according to claim 15, further comprising:

multiple sets of production parameters relating to filling the capsules, wherein at least one of the ratio between the stopping times and the movement times of the conveyor wheel, a drive speed of the process station of the plurality of process stations, and the drive speed and the stroke path of the process station of the plurality of process stations is set in accordance with selection of a set of production parameters of the multiple sets of production parameters.

20. The apparatus according to claim 19, wherein the set of production parameters includes identification of the material for filling the capsules.

21. The apparatus according to claim 15, wherein the drive speed of the process station is controlled independent of the conveyor wheel.

* * * * *